US006629739B2

(12) United States Patent
Korol

(10) Patent No.: US 6,629,739 B2
(45) Date of Patent: Oct. 7, 2003

(54) APPARATUS AND METHOD FOR DROP SIZE SWITCHING IN INK JET PRINTING

(75) Inventor: Steven V. Korol, Dundee, OR (US)

(73) Assignee: Xerox Corporation, Stamford, CT (US)

( * ) Notice: Subject to any disclaimer, the term of this patent is extended or adjusted under 35 U.S.C. 154(b) by 114 days.

(21) Appl. No.: 09/738,676

(22) Filed: Dec. 14, 2000

(65) Prior Publication Data

US 2001/0022596 A1 Sep. 20, 2001

Related U.S. Application Data

(60) Provisional application No. 60/172,496, filed on Dec. 17, 1999.

(51) Int. Cl.[7] ..... B41J 29/38

(52) U.S. Cl. ..... 347/10; 347/11

(58) Field of Search ..... 347/10, 11, 15, 347/131; 358/456, 3.06, 3.13, 3.14, 3.16, 3.19, 535, 466

(56) References Cited

U.S. PATENT DOCUMENTS

| | | | | |
|---|---|---|---|---|
| 3,946,398 A | | 3/1976 | Kyser et al. | 346/1 |
| 4,499,479 A | | 2/1985 | Lee et al. | 346/140 |
| 4,639,735 A | | 1/1987 | Yamamoto et al. | 346/1.1 |
| 4,680,645 A | | 7/1987 | Dispoto et al. | 358/298 |
| 4,746,935 A | | 5/1988 | Allen | 346/140 |
| 5,111,310 A | | 5/1992 | Parker et al. | 358/456 |
| 5,124,716 A | | 6/1992 | Roy et al. | 346/1.1 |
| 5,323,247 A | | 6/1994 | Parker et al. | 358/456 |
| 5,341,228 A | | 8/1994 | Parker et al. | 358/534 |
| 5,689,291 A | | 11/1997 | Tence | 347/10 |
| 5,708,518 A | | 1/1998 | Parker | 358/534 |
| 5,742,405 A | | 4/1998 | Spaulding et al. | 358/456 |
| 5,777,757 A | * | 7/1998 | Karlsson et al. | 358/458 |
| 6,352,335 B1 | * | 3/2002 | Koyama et al. | 347/37 |

* cited by examiner

*Primary Examiner*—Stephen D. Meier
*Assistant Examiner*—Lam Nguyen
(74) *Attorney, Agent, or Firm*—Philip T. Virga

(57) ABSTRACT

An apparatus and method provide on-demand drop volume modulation by utilizing a single transducer driving waveform to drive an ink jet. The driving waveform includes at least a first portion and a second portion that each excites a different modal resonance of ink in an ink jet orifice to produce ink drops having different volumes. A control signal is applied to the driving waveform to actuate the selected portion of the waveform to eject the desired ink drop volume. The apparatus and method improves resolution in gray scale printing by knowing an input request and placing a combination of small drops and large drops in a conventional blue noise halftone screen represented as a threshold array such that throughput and image quality goals are met while decreasing jetting robustness risk.

15 Claims, 8 Drawing Sheets

330

| | DSS Critical Parameter Usage | 332 First Bitmaps | 336 First PostScript | 338 Proposed Final Rev. |
|---|---|---|---|---|
| 316 | Peak: | (25,31) | (33,71) | (33,33) |
| 320 | Max: | (50,0) | (66,0) | (66,0) |
| 314 | Slope 1: | 1.24 | 2.15 | 1 |
| 318 | Slope 2: | -1.24 | -2.15 | -1 |
| 322 | Slope 3: | 1.24 | 2.15 | 1 |
| 324 | Slope 4: | 1.38 | 0.85 | 1.97 |
| 334 | Op. Freq.: | 18 kHz | 15 kHz | 15 kHz |

FIG. 8

APPARATUS AND METHOD FOR DROP SIZE SWITCHING IN INK JET PRINTING

This application claims benefit of provisional application No. 60/172,496 filed Dec. 17, 1999.

FIELD OF INVENTION

This invention relates generally to an apparatus and method for improving resolution in gray scale printing and, more specifically, to an apparatus and method for modulated drop volume ink jet printing that utilizes a single driving waveform to produce on-demand multiple ink drop sizes from a single orifice. More specifically, knowing an input request, a combination of small drops and large drops are placed in a conventional blue noise halftone screen represented as a threshold array according to a unique drop deposition algorithm such that throughput and image quality goals are met while decreasing jetting robustness risk.

BACKGROUND OF THE INVENTION

Prior drop-on-demand ink jet print heads typically eject ink drops of a single volume that produce on a print medium dots of ink sized to provide printing at a given resolution, such as 12 dots per millimeter (300 dots per inch (dpi)). Single dot size printing is acceptable for most text and graphics printing applications that do not require high image quality. Higher image quality, such as "photographic" image quality, normally requires higher resolution, which slows the print speed. Image quality may also be improved by adding ink color densities, which undesirably requires an increase in the number of jets in the print head.

Another technique for improving image quality is to modulate the reflectance, or gray scale, of the dots forming the image. In single dot size printing, the average reflectance of an image portion is typically modulated by a process referred to as "dithering." In a dithering process the perceived intensity of an array of dots is modulated by selectively printing the array at a predetermined dot density. For example, if a 50 percent local average reflectance is desired, half of the dots in the array are printed. A "checker-board" pattern provides the most uniform appearing 50 percent local average reflectance. Multiple dither pattern dot densities are possible to provide a wide range of reflectance levels.

However, dithering necessitates a trade off between the number of possible reflectance levels and the dot array area required to achieve those levels. Eight-by-eight dot array dithering in a printer having 12 dot per millimeter resolution results in an effective gray scale resolution as low as 3 dots per millimeter (75 dots per inch). Gray scale images printed with such dither array patterns often appear grainy and suffer from poor image quality, especially in areas having a low optical density.

One approach to improving the quality of gray scale images printed with dithering is ink dot size modulation, also referred to as drop volume and drop mass modulation. Ink drop volume modulation entails controlling the volume of each drop of ink ejected by the ink jet print head. Drop volume modulation advantageously provides greater effective printing resolution without sacrificing print speed. For example, an image printed with two dot sizes at 12 dots per millimeter (300 dots per inch) resolution may have a better appearance than the same image printed with one dot size at 24 dots per millimeter (600 dots per inch) resolution. This increase in effective resolution is possible because using two or more dot sizes in low optical density areas increases the dot density (dots/area), which in turn decreases graininess.

There are previously known apparatus and methods for modulating the volume of ink drops ejected from an ink jet print head. U.S. Pat. No. 3,946,398 for a METHOD AND APPARATUS FOR RECORDING WITH WRITING FLUIDS AND DROP PROJECTION MEANS THEREFORE describes a variable drop volume drop-on-demand ink jet head that ejects ink drops in response to pressure pulses developed in an ink pressure chamber by a piezoelectric transducer (hereafter referred to as a "PZT"). Drop volume modulation entails varying an amount of electrical waveform energy applied to the PZT for the generation of each pressure pulse. However, it is noted that varying the drop volume may also vary the drop ejection velocity and result in drop landing position errors. Constant drop volume, therefore, is taught as a way of maintaining image quality. The drop ejection rate is also limited to about 3000 drops per second (3 kHz), a rate that is slow compared to typical printing speed requirements.

U.S. Pat. No. 5,124,716 for a METHOD AND APPARATUS FOR PRINTING WITH INK DROPS OF VARYING SIZES USING A DROP-ON-DEMAND INK JET PRINT HEAD, assigned to the assignee of the present invention, and U.S. Pat. No. 4,639,735 for APPARATUS FOR DRIVING LIQUID JET HEAD describe circuits and PZT drive waveforms suitable for ejecting ink drops smaller than an ink jet orifice diameter. However, a separate drive waveform must be generated and applied to the PZT for each different drop size. The waveform generating componentry required to produce the multiple waveforms is undesirably complex and adds additional cost to the printer.

Another approach to modulating drop volume is disclosed in U.S. Pat. No. 4,746,935 for a MULTITONE INK JET PRINTER AND METHOD OF OPERATION. This describes an ink jet print head having multiple orifice sizes, each optimized to eject a particular drop volume. Of course, such a print head is significantly more complex than a single size orifice print head and still requires a very small orifice to produce the smallest drop volume.

U.S. Pat. No. 5,689,291 for a METHOD AND APPARATUS FOR PRODUCING DOT SIZE MODULATED INK JET PRINTING, assigned to the assignee of the present application, provides multiple PZT drive waveforms for producing various ink drop volumes. The various ejected ink drop volumes have substantially the same ejection velocity over a range of drop ejection repetition rates. As with other previous systems, a different drive waveform must be generated and applied to the PZT for each drop volume desired.

What is needed, therefore, is a simple and inexpensive ink jet print head system that provides high-resolution drop volume modulation without requiring multiple drive waveforms and meeting throughput and image quality goals while decreasing jetting robustness risk. This need is met by the apparatus and method of the present invention.

SUMMARY OF THE INVENTION

It is an aspect of the present invention to provide a simple and inexpensive ink jet printing apparatus and method for improving resolution in gray scale printing without compromising print speed.

It is another aspect of the present invention to provide an ink jet printing apparatus and method for increasing ink drop density for a given image optical density.

It is yet another aspect of the present invention to provide an ink jet printing apparatus and method that are capable of on-demand selection of multiple volumetric ink drop sizes for a given pixel on a receiving surface.

It is a feature of the present invention to provide an ink jet printing apparatus and method that utilize two or more ink drop volumes to improve ink drop density and thereby decrease image graininess in low optical density areas.

It is another feature of the present invention that two or more ink drop volumes are generated from a single driving waveform.

It is still another feature of the present invention that a control signal is utilized to manipulate the driving waveform to eject the desired ink drop volume for a given pixel.

It is yet another feature of the present invention to provide a high resolution gray scale ink jet printing apparatus and method that utilizes drop volume modulation without requiring extensive waveform generating and control componentry or multiple jet and/or orifice sizes.

It is an advantage of the present invention that the apparatus and method perform on-demand selection of two or more drop volumes for a given pixel without sacrificing print speed.

It is another advantage of the present invention that a single set of waveform generating and control components is utilized to achieve on-demand multiple drop volume printing.

To achieve the foregoing and other aspects, features and advantages, and in accordance with the purposes of the present invention as described herein, an apparatus and method provide on-demand drop volume modulation by utilizing a single transducer drive waveform. The drive waveform includes at least a first portion and a second portion that each excites a different modal resonance of ink in an ink jet orifice to produce ink drops having different volumes. The apparatus and method improves resolution in gray scale printing by knowing an input request and placing a combination of small drops and large drops in a conventional blue noise halftone screen represented as a threshold array according to a unique drop deposition algorithm such that throughput and image quality goals are met while decreasing jetting robustness risk.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

FIG. 7 is a table displaying critical parameter usage for the algorithm illustrated in FIG. 6 in accordance with the present invention.

DETAILED DESCRIPTION OF THE PREFERRED EMBODIMENT

Figure 1:
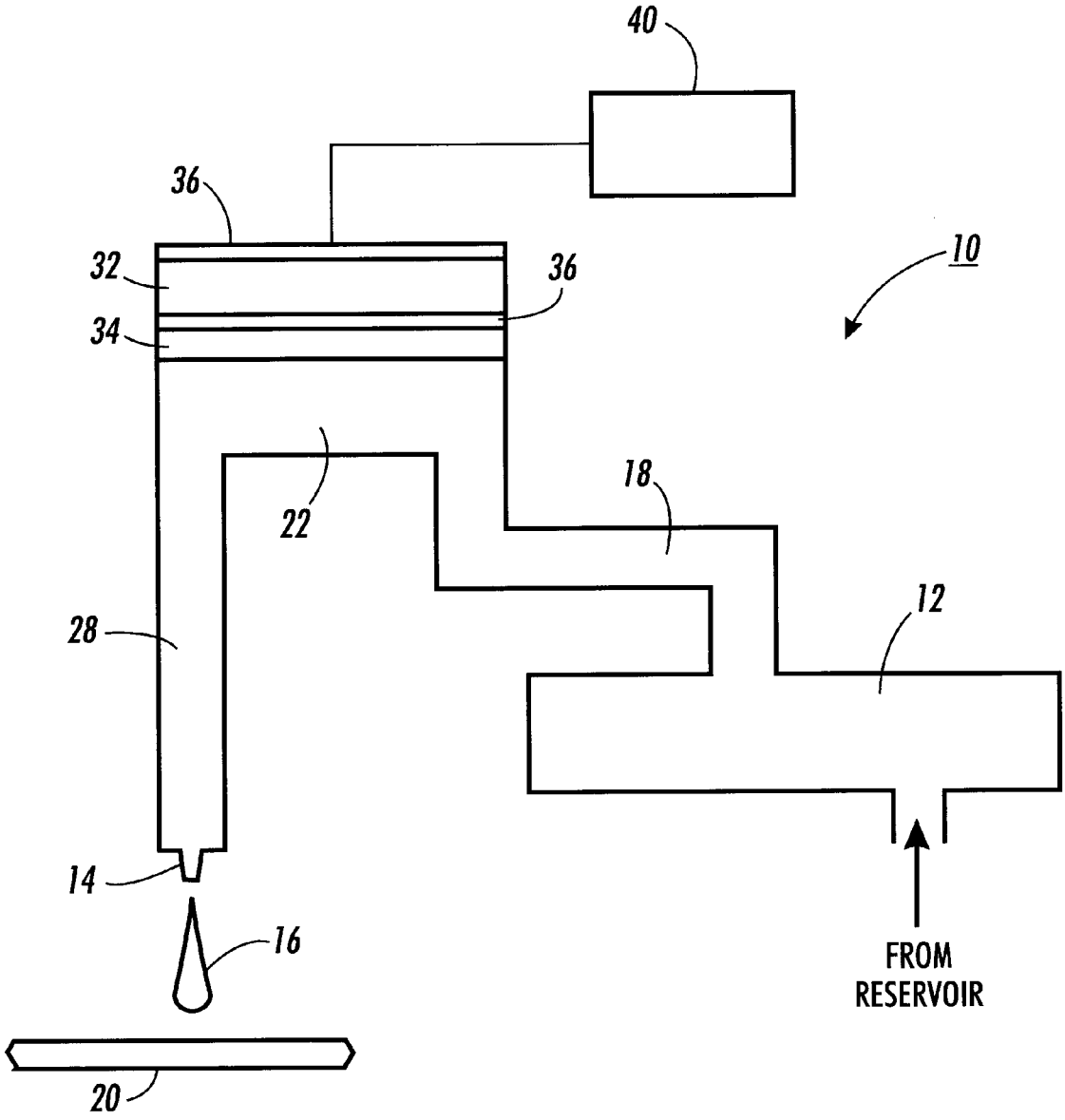
FIG. 1 is an enlarged schematic view of a preferred PZT driven ink jet suitable for use with this invention.

FIG. 1 shows a schematic view of an individual ink jet 10 according to the present invention. The ink jet 10 is a part of a multiple-orifice ink jet print head suitable for use with this invention. Ink jet 10 includes an ink manifold 12 that receives ink from a reservoir (not shown). Ink flows from manifold 12 through an inlet channel 18 into an ink pressure chamber 22. Ink flows from the pressure chamber 22 into an outlet channel 28 to the ink drop forming orifice 14, from which an ink drop 16 is ejected toward a receiving surface 20.

A typical ink jet print head includes an array of orifices that are closely spaced from one another for use in ejecting drops of ink toward a receiving surface. The typical print head also has at least four manifolds for receiving black, cyan, magenta and yellow ink for use in monochrome plus subtractive color printing. However, the number of such manifolds may be varied where a printer is designed to print solely in black ink, gray scale or with less than a full range of color.

Returning to the ink jet 10 of FIG. 1, ink pressure chamber 22 is bounded on one side by a flexible diaphragm 34. An electro mechanical transducer 32, such as a piezoelectric transducer (PZT), is secured to diaphragm 34 by an appropriate adhesive and overlays ink pressure chamber 22. The transducer mechanism 32 can comprise a ceramic transducer bonded with epoxy to the diaphragm plate 34, with the transducer centered over the ink pressure chamber 22. The transducer may be substantially rectangular in shape, or alternatively, may be substantially circular or disc-shaped. In a conventional manner, transducer 32 has metal film layers 36 to which an electronic transducer driver 40 is electrically connected. The preferred transducer 32 is a bending-mode transducer. It will be appreciated that other types and forms of transducers may also be used, such as shear-mode, annular constrictive, electrostrictive, electromagnetic or magnetostrictive transducers.

Transducer 32 is operated in its bending mode such that when a voltage is applied across metal film layers 34, transducer 32 attempts to change its dimensions. Because it is securely and rigidly attached to diaphragm 34, transducer 32 bends and deforms diaphragm 34, thereby displacing ink in ink pressure chamber 22 and causing the outward flow of ink through outlet channel 28 to nozzle 14. Refill of ink pressure chamber 22 following the ejection of an ink drop is accomplished by reverse bending of transducer 32 and the resulting movement of diaphragm 34.

Ink jet 10 may be formed from multiple laminated plates or sheets, such as sheets of stainless steel, that are stacked in a superimposed relationship. An example of a multiple-plate ink jet is disclosed in U.S. Pat. No. 5,689,291 entitled METHOD AND APPARATUS FOR PRODUCING DOT SIZE MODULATED INK JET PRINTING, and assigned to the assignee of the present application. U.S. Pat. No. 5,689,291 is specifically incorporated by reference in pertinent part. It will be appreciated that various numbers and combinations of plates may be utilized to form the ink jet 10 and its individual components and features. Persons skilled in the art will also recognize that other modifications and additional features may be utilized with this type of ink jet to achieve a desired level of performance and/or reliability. For example, acoustic filters may be incorporated into the ink jet to dampen extraneous and potentially harmful pressure waves. The positioning of the manifolds, pressure chambers and inlet and outlet U-E channels in the print head may also be modified to control ink jet performance.

To eject an ink drop from an ink jet such as that of FIG. 1, a driving waveform is provided to transducer 32 from a transducer driver 40. Transducer 32 responds to the driving waveform by inducing pressure waves in the ink that excite ink fluid flow resonances in orifice 14 and at the ink surface meniscus. The particular resonance mode excited by the waveform determines the drop volume ejected.

Designing drive waveforms suitable for ejecting a desired drop volume generally involves concentrating energy at frequencies near the natural frequency of a desired mode, and suppressing energy at the natural frequencies of other modes. Extraneous and parasitic resonant frequencies that compete for energy with the desired mode should also be controlled. A more detailed discussion of designing drive waveforms is found in the earlier referenced and incorporated U.S. Pat. No. 5,689,291.

Figure 2A:
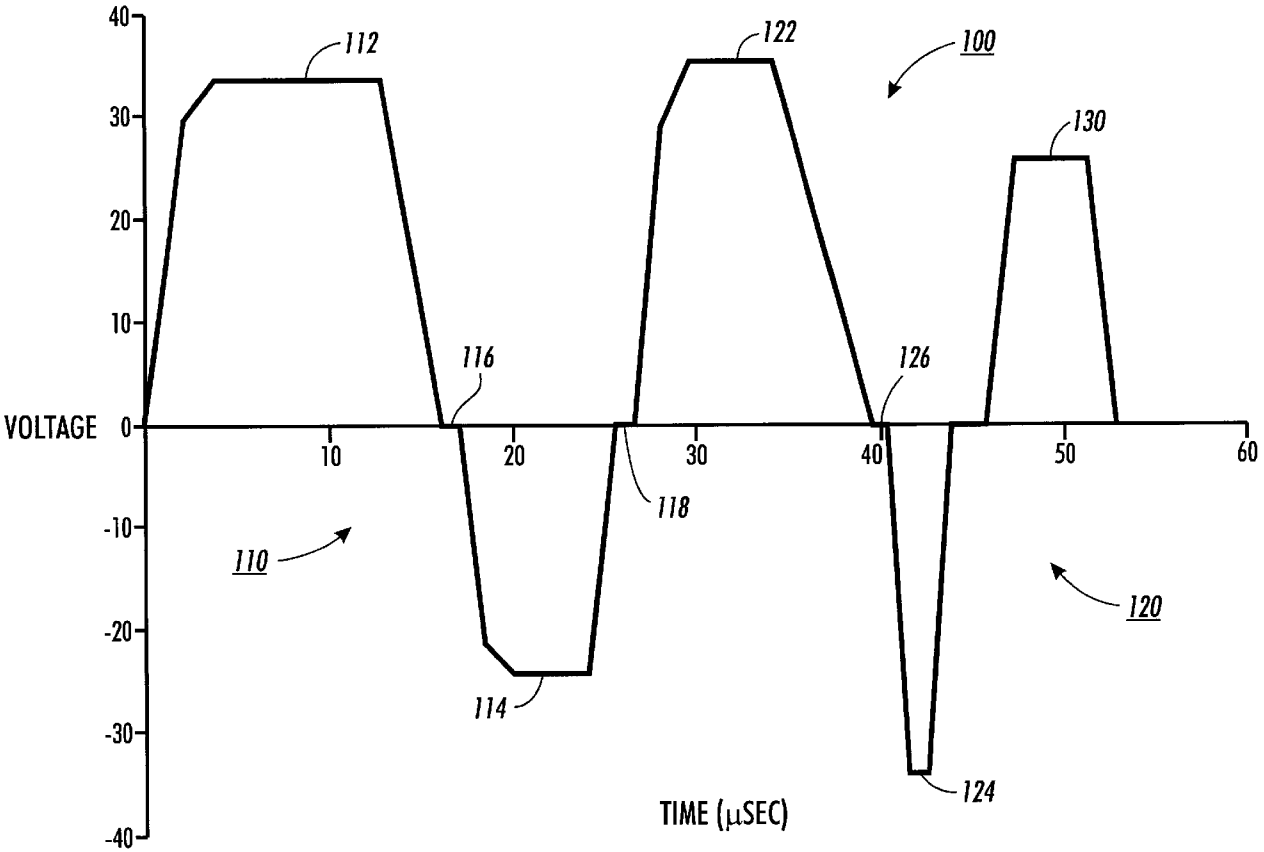
FIG. 2*a* is a graphical waveform diagram showing the electrical voltage and timing of a preferred transducer driving waveform.
Figure 3:
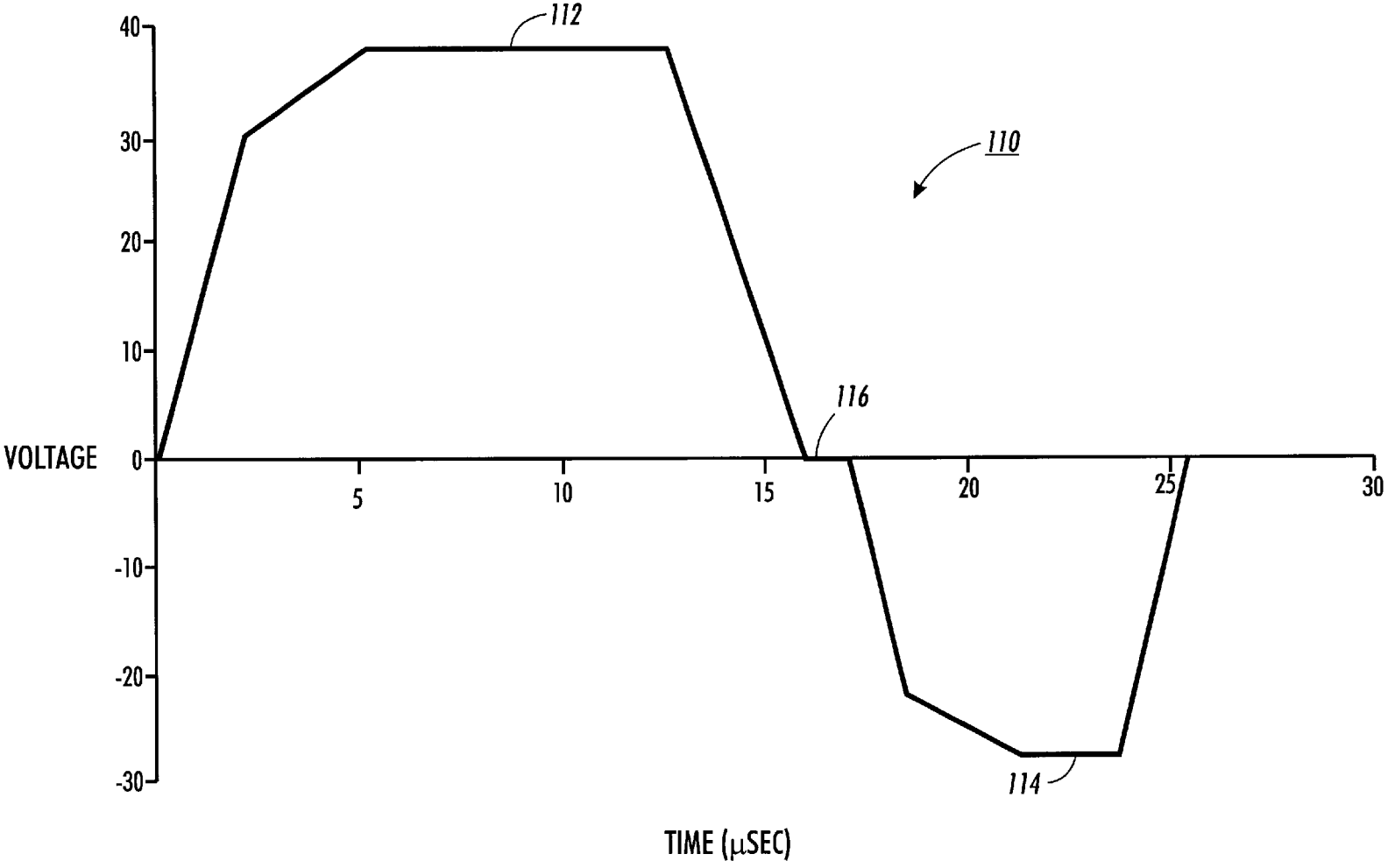
FIG. 3 is a graphical waveform diagram illustrating a first portion of the driving waveform of FIG. 2*a;*

As discussed earlier, prior ink jet systems capable of producing multiple ink drop volumes from a single orifice have required separate and distinct driving waveforms for each drop volume desired. Advantageously, and in an important aspect of the present invention, the method and apparatus described herein utilize a single driving waveform that includes multiple portions for producing ink drops having multiple volumes. With reference now to FIG. 2*a*, a preferred embodiment of the driving waveform of the present invention will now be described. The driving waveform 100 includes a first bi-polar portion 110 and a second bi-polar portion 120 that includes two positive pulses. With reference now to FIG. 3, the first portion 110 of the driving waveform 100 includes a plus 35 volt, 16 microsecond pulse component 112 and a negative 26 volt, 9 microsecond pulse component 114 separated by a 1 microsecond wait period 116.

Figure 4:
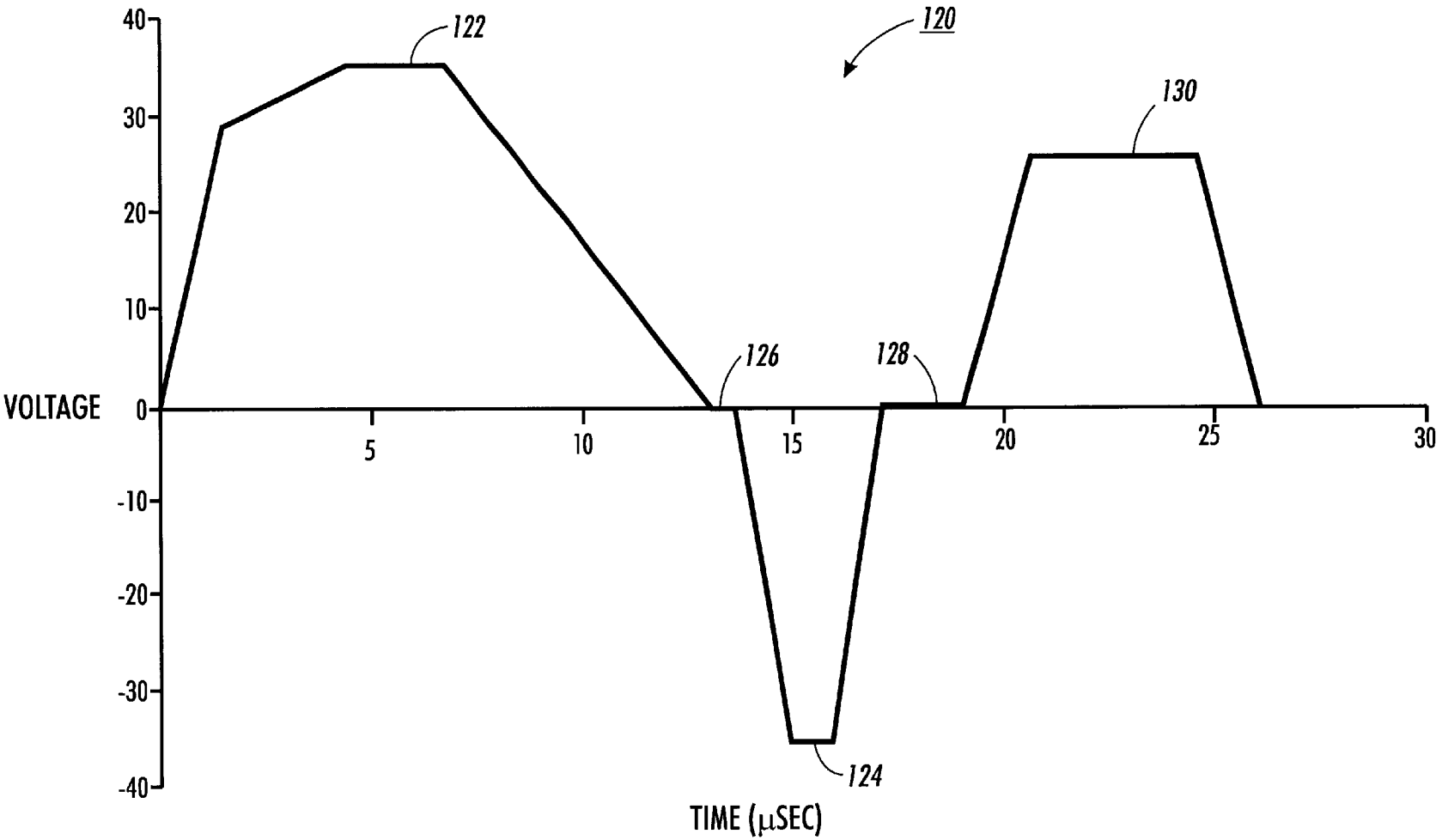
FIG. 4 is a graphical waveform diagram illustrating a second portion of the driving waveform of FIG. 2*a;*

With reference again to FIG. 2*a*, the second portion 120 of the driving waveform follows the first portion 110 after a 1 microsecond wait period 118. With reference now to FIG. 4, a preferred embodiment of the second portion waveform 120 is illustrated. The second portion waveform 120 includes a plus 35 volt, 13 microsecond pulse component 122 and a negative 35 volt, 4 microsecond pulse component 124 separated by a 0.5 microsecond wait period 126. Following 4 the negative pulse component 124 and a 2 microsecond wait period 128 is a second positive voltage pulse comprising a plus 26 volt, 7 microsecond pulse component 130.

The first and second portions 110, 120 of the driving waveform 100 are each designed to generate ink drops having a different volume. For example, when utilized with an ink jet of the type shown in FIG. 1, the first portion waveform 110 generates an ink drop having a volume of approximately 58 picoliters, and the second portion waveform 120 generates an ink drop having a volume of approximately 27 picoliters.

To select a desired drop size for a given pixel, and in another important aspect of the present invention, a control signal is applied to the driving waveform 100 to enable the desired portion of the driving waveform to actuate the transducer and eject a fluid drop having a desired volume. Advantageously, this combination of a single, multiple drop size driving waveform and control signal allows for pixel-by-pixel, on-demand selection of multiple ink drop sizes. For example, in an offset ink jet printing architecture utilizing a rotating receiving surface and a translating print head, the print head may eject multiple ink drop volumes during a single rotation of the receiving surface. Additionally, output containing multiple ink drop sizes may be created on a receiving surface at a constant speed.

Figure 2B:
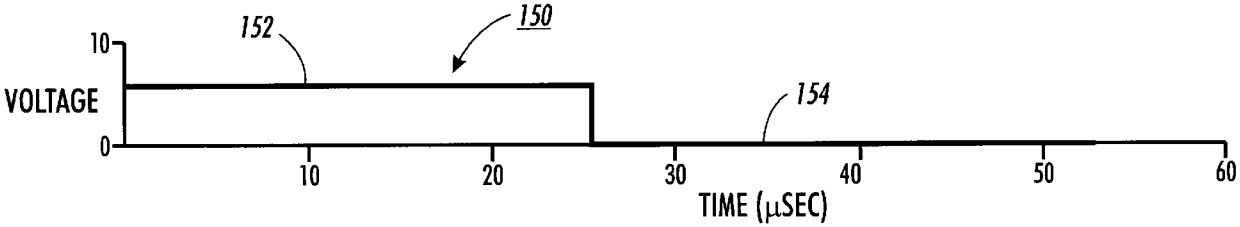
FIG. 2*b* is a graphical waveform diagram plotted over the same time sequence as FIG. 2*a* showing the electrical voltage and timing of a preferred control signal waveform used to actuate a desired portion of the driving waveform.

With reference now to FIG. 2*b*, in the preferred embodiment the control signal 150 is a substantially rectangular waveform that includes an actuation component 152 having a positive voltage and a cancellation component 154 having a zero voltage. Preferably, the actuation component 152 is a 5 volt pulse having a duration substantially equal to the driving waveform portion being actuated. The cancellation component 154 is a 0 volt flat line having a duration substantially equal to the driving waveform portion not selected. As an example, FIGS. 2*a* and 2*b* graphically illustrate the actuation of the first portion 110 of the driving waveform 100 and the cancellation of the second portion 120 of the waveform, thereby producing a 58 picoliter ink drop. In the case where the second portion 120 of the driving waveform 100 is selected, the actuation component 152 of the control signal 150 is applied to correspond to the second portion 120 of the waveform, and the cancellation component 154 corresponds to the first portion 110. In this manner, the control signal enables the desired portion of the driving waveform and cancels the non-selected portion to eject the desired volume ink drop for a given pixel. It will also be appreciated that the entire control signal 150 will be a 0 volt flat line that cancels the entire driving waveform 100 when no ink drop is desired for a given pixel.

Figure 5:
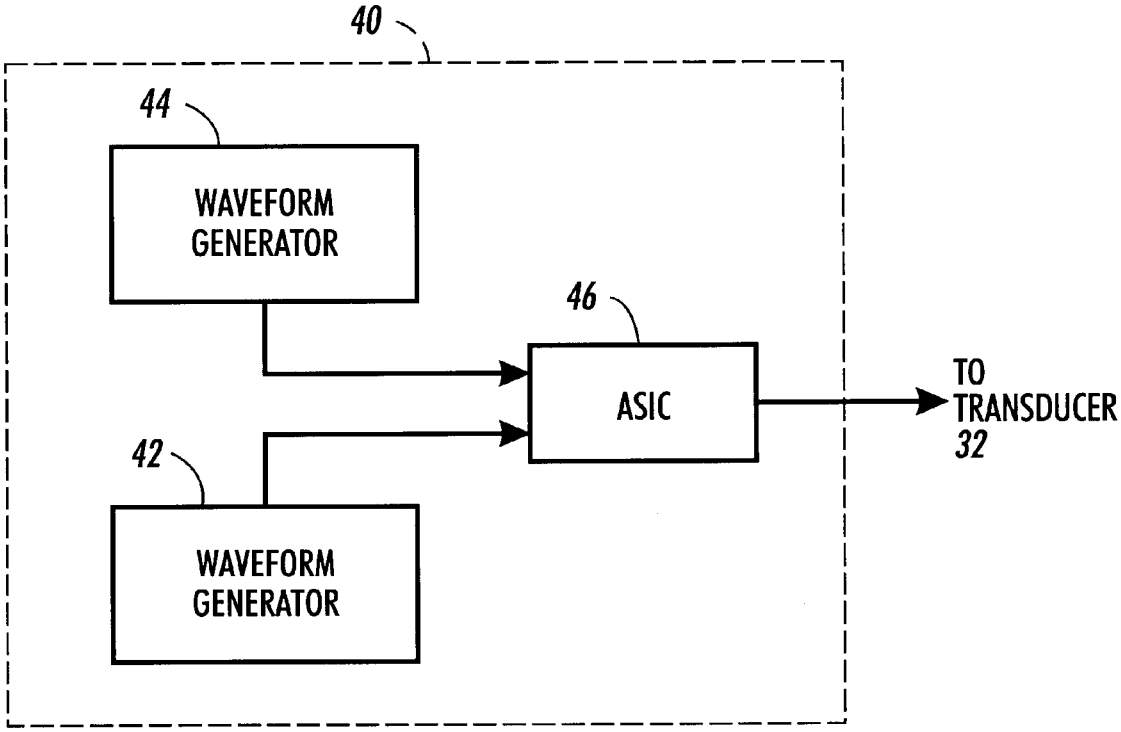
FIG. 5 is a schematic block diagram of apparatus used to generate the transducer driving waveform and control signal of FIGS. 2*a* and 2*b;*

FIG. 5 schematically illustrates apparatus representative of the transducer driver 40 (see FIG. 1) that is suitable for generating the driving waveform 100 and the control signal 150. The transducer driver 40 includes an image loader 42 that generates the control signal 150 and a waveform generator 44 that generates the driving waveform 100. Any suitable commercial waveform generator may be utilized, such as an A.W.G. 2005 waveform generator, manufactured by Tektronix, Inc. The waveform generator 44 and image loader 42 are electrically connected to an ASIC 46 that provides an output signal suitable for driving the metal film layers 34 of the transducer 32. The image loader 42 determines ink drop volume by generating the control signal 150 to selectively enable either the first portion 110, the second portion 120 or neither portion of the driving waveform 100 to actuate the transducer 32 for each pixel in a bit map image.

Depending upon the printing speed desired, the waveform generator 44 generates the driving waveform 100 and the image loader 42 generates the control signal 150 at a frequency that ejects fluid drops at a rate of between about 10,000 drops per second to about 50,000 drops per second, and more preferably at a rate between 15,000 to 18,000 drops per second. Advantageously, the use of a single, multiple drop size driving waveform and control signal requires only one set of waveform generating and control components, thereby simplifying and reducing the cost of an ink jet printer utilizing the present invention.

The present method and apparatus for on-demand drop size modulation are most advantageously utilized to print low optical density images or areas. As explained above, for a given printing resolution, lower optical density images generally require a higher degree of dithering, which often results in grainy images when a single drop size is used. Using smaller drops in low optical density regions through drop size switching at the same printing resolution advantageously decreases graininess by increasing dot density in these regions. Dot position in low optical density areas is less critical than in other areas that utilize less dithering. Therefore, the preferred driving waveform portions 110 and 120 are optimized to eject an ink drop at substantially the same velocity to give a substantially equal transit time for drop travel to the receiving surface independent of drop size. Alternatively, where greater precision in dot position is desired, the second portion waveform 120 may be designed to eject an ink drop with a higher velocity than an ink drop ejected by the first portion waveform 110. The difference in velocities may be optimized to overcome the time delay between the second portion waveform 120 and the first portion 110 to thereby improve dot position accuracy.

Figure 6A:
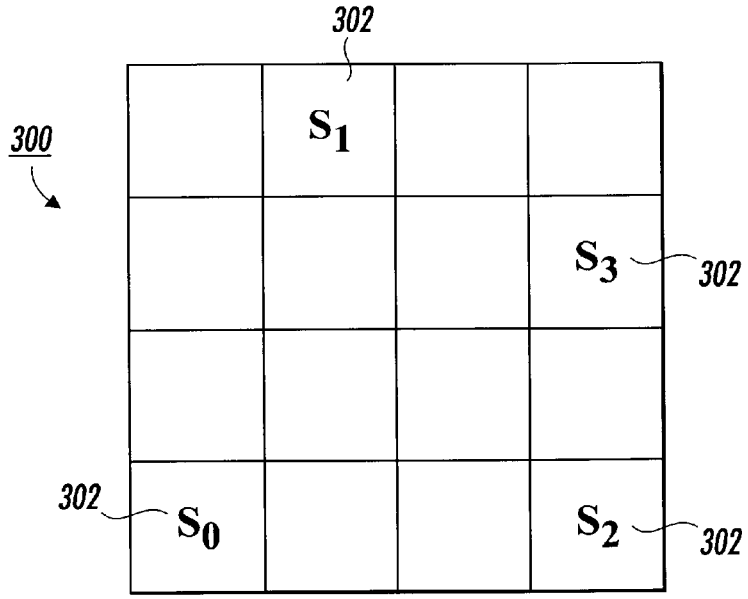
FIG. 6*a* diagrammatically illustrates using small drops with the algorithm of the present invention using a conventional blue noise halftone screen.
Figure 6B:
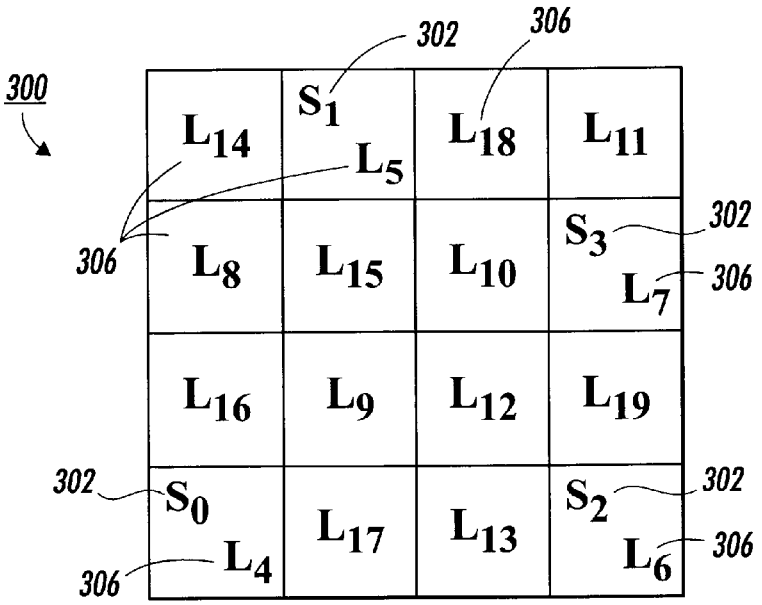
FIG. 6*b* diagrammatically illustrates using drops with the algorithm of the present invention with the conventional blue noise halftone screen of FIG. 6*a*.

In accordance with a preferred embodiment of the present invention, a maximum firing rate of approximately 15,000 drops per second, or 15 kHz is used. However, it should be noted that to optimize the reliability of the ink jet and preserve individual drop integrity, different maximum firing rates might be utilized when switching between drop sizes. Referring now to FIGS. 6*a* and 6*b* there is diagrammatically illustrated using a conventional blue noise halftone screen 300 in accordance with the algorithm of the present invention, as will be more fully described below. It should be understood, that the invention may be applied to any halftoning technique whether it be an error diffusion method or conventional ordered dither. A conventional blue noise halftone screen 300 is represented as a threshold array or grid having two potential drop locations $L_n$ 306 and $S_m$ 302. While the conventional blue noise halftone screen 300 provides one example of such a threshold array, it is common for the dimensions of the array to be from 128 to 256 rows by 128 to 256 columns. Each drop location $L_n$ 306 corresponds to a "large" ink drop of a desired volume that is generated by the first portion 110 of the driving waveform 100. Each potential drop location $S_m$ 302 corresponds to a"small" ink drop of a desired volume that is generated by the second portion 120 of the driving waveform. It will be appreciated that each drop location in FIGS. 6*a* and 6*b* is addressed by one cycle of the driving waveform 100.

Using a conventional blue noise halftone screen such as that represented as grid 300, the algorithm in accordance with the present invention (shown graphically in FIG. 7 and described more fully below) ramps through graylevels according to PostScript convention, beginning first with small drops $S_m$ 302. The grid 300 continues to be filled with small drops $S_m$ 302, shown in placement order as $S_0$ through $S_4$ until a peak value is reached. Once the peak value is reached the large drops $L_n$ 306 replace the small drops $S_m$ 302 following the placement order, shown as $L_4$ through $L_7$ in which the small drops $S_m$ 302 were initially placed. Once all of the small drops $S_m$ 302 have been replaced with large drops $L_n$ 306, the large drops $L_n$ 306 continue to fill the grid 300, shown as $L_8$ through $L_{18}$ according to the blue noise halftone screen until no vacancies remain. Therefore, the grid 300 continues to be filled with small drops $S_m$ 302 until a peak value of 25% for a sample 4×4 blue noise halftone screen is reached. After 25% of the array is addressed with small drops $S_m$ 302, big drops $L_n$ 306 begin replacing the small drops $S_m$ 302.

Figure 7:
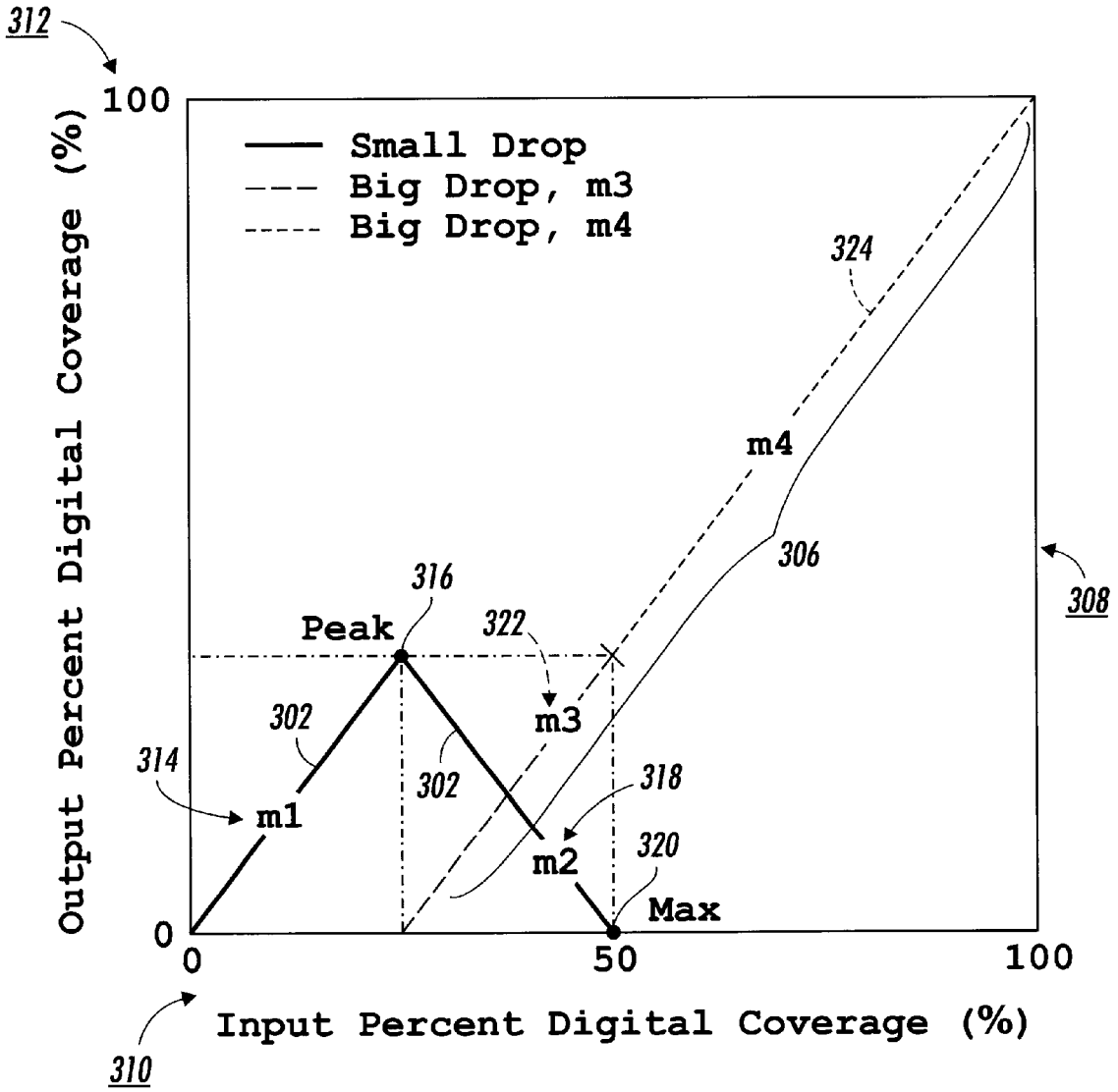
FIG. 7 graphically illustrates the algorithm of the present invention by which a drop size switching halftone cell is filled according to one preferred embodiment illustrated in FIGS. 6*a* and 6*b*.

Turning now to FIG. 7, the graphical algorithm by which a drop size switching halftone cell such as grid 300 is filled according to one preferred embodiment of the present invention is shown. The abscissa 310 represents the to input percent digital coverage and the ordinate 312 the output digital percent coverage. Note that depending on the input request, the output may be comprised of small drops $S_m$ 302, big drops $L_n$ 306, or a combination of the two. As plotted, small drops $S_m$ 302 increase at a slope of m1 314 (output percent digital coverage over input percent digital coverage) until the peak value (labeled Peak) 316 is reached. At this point, large drops $L_n$ 306 begin replacing small drops $S_m$ 302 until no small drops $S_m$ 302 remain (labeled Max) 320. Note that slopes m2 318 and m3 322 are inverse of one another. Beyond the input point corresponding to Max 320, all small drops $S_m$ 302 have been replaced and large drops $L_n$ 306 continue to fill the grid 300 according to slope m4 324, which may be adjusted somewhat according to desired tone reproduction characteristics of mid to high optical density regions. Any further adjustments made to tone reproduction must be made is such a way so that the parameters described above are not overridden. Such image processing adjustments are made to the input request prior to image processing via the algorithm described above.

Additionally, there are two issues that provide the bounds for the critical parameters used in FIG. 7. In general, image quality increases as the Peak 316 moves toward the point (50,100). This would represent full utilization of the small drop $S_m$ 302. Due to the drop gain behavior of solid ink, in actuality, a point of diminishing returns is reached somewhere around 50% digital coverage of the small drop. Also, jetting robustness moves in opposition to image quality in this mode, so that greater the usage of small drops $S_m$ 302 in combination with big drops $L_n$ 306, the greater the jetting robustness risk. For these reasons, the Peak 316 and Max 320 values must be chosen to maximize image quality while balancing jetting robustness risk.

FIG. 8 lists the specifics in tabular form implementing the algorithm of the present invention on an LP-3 printer as provided by the Tektronix Corporation. Therefore, FIG. 8 presents a final version of the drop size switching critical parameter usage for this type of printer. As shown, image quality and initial jetting robustness goals were met using the parameters under First Bitmap Implementation 332. In the First Postscript Implementation 336, small drop $S_m$ 302 usage was much greater than in the previous implementation, as can be seen by both the Peak 316 and Max 320 values and slopes m1 314 and m2 318. Jetting robustness issues at this operating point forced the operating frequency 334 to drop to 15 kHz. Even so, throughput goals were met. Due to the fact that greater small drop $S_m$ 302 usage represents greater jetting robustness risk and that print quality goals were met according to the First Bitmap Implementation 332 , the final version shifted the parameters much closer to their earlier values while maintaining the 15 kHz operating frequency. In so doing, print quality and throughput goals were met with an increased margin of safety for jetting robustness. This is shown in the Final PostScript Implementation 338 wherein the slopes m1 314 and m3 322 are 1.00, m2 318 is −1.00, and m4 is 1.97, with a peak of 316 (33,33) and max 320 value of (66,0). Therefore, using the graphically depicted algorithm of FIG. 7 and knowing the input request, the slopes (output percent digital coverage over input percent digital coverage) and combination of small drops and large drops may be determined such that throughput and image quality goals are met while decreasing jetting robustness risk.

It will be appreciated that maximum drop ejection rates exceeding 18 kHz are possible using a more optimized ink jet design. Such an ink jet design will eliminate internal resonant frequencies close to those required to excite orifice resonance modes needed for drop volume modulation. Additionally, adjusted drop ejection rates exceeding those referenced above for drop size switching are possible with an optimized ink jet design.

An ink jet printer according to the present invention includes a print head having multiple ink jets 10 as described above. Examples of an ink jet print head and an ink jet printer architecture are disclosed in U.S. Pat. No. 5,677,718 entitled DROP-ON-DEMAND INK JET PRINT HEAD HAVING IMPROVED PURGING PERFORMANCE and U.S. Pat. No. 5,389,958 entitled IMAGING PROCESS, both patents assigned to the assignee of the present application. U.S. Pat. Nos. 5,677,718 and 5,389,958 are specifically incorporated by reference in pertinent part. It will be appreciated that other ink jet print head constructions and ink jet printer architectures may be utilized in practicing the present invention.

The method and apparatus of the present invention may be practiced to jet various fluid types including, but not limited to, aqueous and phase-change inks of various colors. Likewise, skilled workers will recognize that other driving waveforms having various ink drop forming portions may be utilized. Additionally, in an alternative embodiment of the preferred driving waveform 100, the second portion waveform 120 may precede the first portion waveform 110 in each cycle. It will also be noted that this invention is useful in combination with various prior art techniques including dithering and electric field drop acceleration to provide enhanced image quality and drop landing accuracy. The present invention is amenable to any fluid jetting drive mechanism and architecture capable of providing the required drive waveform energy distribution to a suitable orifice and its fluid meniscus surface.

It will be obvious to those having skill in the art that many other changes may be made to the details of the above-described embodiments of this invention without departing from the underlying principles thereof. For example, although described in terms of electrical energy waveforms to drive the transducers, any other suitable energy form could be used to actuate the transducer including, but not limited to, acoustical or microwave energy. Accordingly, it will be appreciated that this invention is applicable to fluid drop size modulation applications other than those found in ink jet printers.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all changes, modifications and variations that may occur to one of skill in the art upon a reading of the disclosure. All patents cited herein are incorporated by reference in their entirety.

What is claimed is:

1. An apparatus for drop size switching in ink jet printing, the apparatus comprising:

a driving waveform having at least a first portion and a second portion; and a control signal applied to the driving waveform, the control signal including an actuation component that enables either the first portion of the driving waveform or the second portion of the driving waveform to actuate a transducer to eject a fluid drop;

the actuation component of the control signal comprises a pulse corresponding to a first portion of the driving waveform to produce one or more large drops or the second portion of the driving waveform to produce one or more small drops;

the control signal enables the one or more small drops of the second portion of the driving waveform to fill the threshold array until a peak value is reached wherein a halftone screen represented as a threshold array is filled whereby throughput and image quality goals are met while decreasing jetting robustness risk; and wherein the control signal enables the one or more large drops of the first portion of the driving waveform to replace the one or more small drops of the second portion of the driving waveform of the threshold array.

2. The apparatus for drop size switching in ink jet printing of claim 1, wherein the control signal enables the one or more large drops of the first portion of the driving waveform to continue to fill the threshold array according to a blue noise halftone screen until no vacancies remain.

3. The apparatus for drop size switching in ink jet printing of claim 2, wherein the control signal enables the one or more large drops of the first portion of the driving waveform to continue to fill the threshold array based on the slope of output percent digital coverage over input percent digital coverage for a given input request until no vacancies remain.

4. The apparatus for drop size switching in ink jet printing of claim 1, wherein the control signal enables the one or more large drops of the first portion of the driving waveform to replace the one or more small drops of the second portion of the driving waveform to continue to fill the threshold array based on the slope of output percent digital coverage over input percent digital coverage for a given input request.

5. The apparatus for drop size switching in ink jet printing of claim 1, wherein the control signal enables the one or more small drops of the second portion of the driving waveform to fill the threshold array based on the slope of output percent digital coverage over input percent digital coverage for a given input request.

6. The apparatus for drop size switching in ink jet printing of claim 1, wherein the waveform generator generates the driving waveform at a frequency that ejects fluid drops from the orifice at a maximum ejection rate of between about 15,000 fluid drops per second to about 18,000 fluid drops per second.

7. The apparatus for drop size switching in ink jet printing of claim 1, wherein the control signal comprises a pulse corresponding to a first portion of the driving waveform producing one or more large drops and the second portion of the driving waveform producing one or more small drops wherein the large drops and small drops continue to fill the threshold array according to a blue noise halftone screen based on the slope of output percent digital coverage over input percent digital coverage for a given input request until no vacancies remain.

8. The method of claim 1, further including the steps of:

generating a driving waveform at a frequency that ejects fluid drops from the orifice at an ejection rate of between about 15,000 fluid drops per second to about 18,000 fluid drops per second.

9. A method for drop size switching in ink jet printing, the method comprising the steps of:

generating a transducer driving waveform comprising at least a first portion and a second portion;

generating a control signal Including an activation component for enabling either the first or second portion of the driving waveform to activate the transducer;

selecting a halftone screen represented as a threshold array;

selecting a halftone screen represented as a threshold array to be filled by ejecting either one or more of the first drops or the second drops;

selectively applying the first portion of the driving waveform to the transducer to eject one or more first drops having a first volume;

selectively applying the second portion of the driving waveform to the transducer to eject one or more second drops having a second volume wherein ejecting the one or more second drops associated with the second portion of the driving waveform to till the threshold array until a peak value is reached; and ejecting the one or more first drops associated with the first portion of the driving waveform to replace the one or more second drops associated with the second portion of the driving waveform to fill the threshold array.

10. The method of claim 9, further including the steps of:

ejecting the one or more first drops associated with the first portion of the driving waveform to continue to fill the threshold array according to a blue noise halftone screen until no vacancies remain.

11. The method of claim 10, further including the steps of:

ejecting the one or more first drops associated with the first portion of the driving waveform to continue to fill the threshold array based on the slope of input percent digital coverage over output percent digital coverage for a given input request until no vacancies remain.

12. The method of claim 9, further including the steps of:

ejecting the one or more first drops associated with the first portion of the driving waveform to replace the one or more second drops of the second portion of the driving waveform to continue to fill the threshold array based on the slope of output percent digital coverage over input percent digital coverage for a given input request.

13. The method of claim 9, further including the steps of:

ejecting the one or more second drops associated with the second portion of the driving waveform to fill the threshold array based on the slope of input percent digital coverage over output percent digital coverage for a given input request.

14. An ink jet printing device including a system for drop size variation, comprising:

a transducer for ejecting a fluid drop;

a transducer driver for generating an actuation waveform for input to the transducer, said transducer driver providing;

a driving waveform having at least a first portion and a second portion;

a control signal applied to the driving waveform, the control signal including an actuation component for enabling either; the first portion of the driving waveform or the second portion of the driving waveform to actuate said transducer for ejection of the fluid drop wherein the first portion of the driving waveform corresponds to an actuation waveform for ejecting a first size fluid drop, and the second portion of the driving waveform corresponds to an actuation waveform for ejecting a second size fluid drop;

said transducer driver is actuated in accordance with a predetermined halftone screen for generating an image, said halftone screen being represented as a threshold array of dots making up the image, and further wherein the actuation component of the control signal is selectively applied to the driving waveform for enabling one or more of the first size fluid drops and one or more of the second size fluid drops to fill the threshold array until a peak value is reached; and wherein the actuation component of the control signal is selectively applied to the driving waveform for enabling one or more of the first size fluid drops to replace one or more of the second size fluid drops to fill the threshold array.

15. The ink jet printing apparatus of claim 14, wherein the predetermined halftone screen is a blue noise halftone screen.

* * * * *